United States Patent [19]

Müller

[11] 4,399,841

[45] Aug. 23, 1983

[54] METHOD AND DEVICE FOR THE MANUFACTURE OF A WOVEN FABRIC AND WOVEN FABRIC MANUFACTURED ACCORDING TO THE METHOD

[75] Inventor: Jakob Müller, Stansstad, Switzerland

[73] Assignee: Textilma AG, Hergiswil, Switzerland

[21] Appl. No.: 302,439

[22] PCT Filed: Feb. 17, 1981

[86] PCT No.: PCT/CH81/00018

§ 371 Date: Sep. 8, 1981

§ 102(e) Date: Sep. 8, 1981

[30] Foreign Application Priority Data

Feb. 21, 1980 [CH] Switzerland ..... 1416/80

[51] Int. Cl.[3] ..... D03D 5/00; D03D 47/42

[52] U.S. Cl. ..... 139/383 R; 139/117; 139/432

[58] Field of Search ..... 139/383 R, 430, 431, 139/432, 116, 117

[56] References Cited

U.S. PATENT DOCUMENTS 1,320,996 11/1919 Turner ..... 139/383 R

FOREIGN PATENT DOCUMENTS 989631 5/1951 France .
274805 7/1951 Switzerland .
598382 4/1978 Switzerland .
119558 10/1918 United Kingdom ..... 139/432
960878 6/1964 United Kingdom ..... 139/383 R
2062702 5/1981 United Kingdom ..... 139/117

*Primary Examiner*—James Kee Chi
*Attorney, Agent, or Firm*—Werner W. Kleeman

[57] ABSTRACT

Method and device on a loom for the manufacture of a woven fabric, wherein weft thread loops are formed by a weft thread in a shed formed of warp threads. Through feeding the weft thread in within the warp width and out to both sides over the outermost warp threads while forming loops, a woven fabric is obtained with like fabric edges which can no longer be distinguished optically.

11 Claims, 3 Drawing Figures

METHOD AND DEVICE FOR THE MANUFACTURE OF A WOVEN FABRIC AND WOVEN FABRIC MANUFACTURED ACCORDING TO THE METHOD

BACKGROUND OF THE INVENTION

The invention concerns a method for manufacturing a woven fabric, in which weft thread loops are formed by at least one weft thread in at least one shed formed of warp threads, a device or apparatus on a loom for the performance of the method as well as a woven fabric manufactured according to the method.

A method for manufacturing a woven web has become known from Swiss Pat. No. 611,353, in which the weft thread is led from one side of the shed into this while forming a loop. On the other side of the shed, the weft thread loops are bound off by two auxiliary threads so that a very resistant fabric edge is obtained. This and similar methods, in which the weft thread is led in from one side, have the disadvantage that visibly different fabric edges are obtained.

SUMMARY OF THE INVENTION

It is an important object of the invention to create a method and a device on a loom for the manufacture of a woven fabric, which displays the advantage that two like fabric edges are obtained, which can no longer be distinguished optically.

The method of manufacturing a woven fabric according to the invention, in which weft thread loops are formed by at least one weft thread in at least one shed formed of warp threads, is manifested by the features that the weft thread is positioned to program for the weft introduction in warp direction within the warp width in the shed and before every beating of the reed is led out towards each shed side over the outermost warp thread while forming a loop extending in zig-zag shape, where it is bound off, retained, glued or fixed with itself or wit an auxiliary thread for the formation of the fabric edges.

The apparatus for the performance of the method contemplates that at least two weft introduction organs are arranged externally of the shed and engaging into the same, apart from the edge forming means arranged on a loom to each side of the fabric.

It is possible to lead the weft thread out first to the one side while forming a first loop and thereupon to lead it out to the other side while forming the second loop. This can take place with the arrangement of a weft thread introduction organ on each side of the shed. In that case, two fork-shaped needles can be used for pushing as well as also two hook-shaped needles for drawing. Advantageously, the weft thread is led out simultaneously to each side while forming two loops, for which in turn a hookshaped or a fork-shaped needle can be arranged on each shed side. Both weft thread introduction organs can also be present on the same shed side and together reach into the shed, wherein a fork-shaped needle forms the first loop while traversing the shed, while the hook-shaped needle forms the second loop on the return. When the weft thread is led in at the centre of the shed and a hook-shaped needle simultaneously reaches from each side into the shed only as far as the centre, wherein the loops are formed during the return of the needles, a very high weaving speed can be attained. Several threads can also be led in by an equipment controllable according to pattern, from which the weft thread can be selected as desired. Finally, it is also feasible to provide several sheds with the corresponding weft introduction organs.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
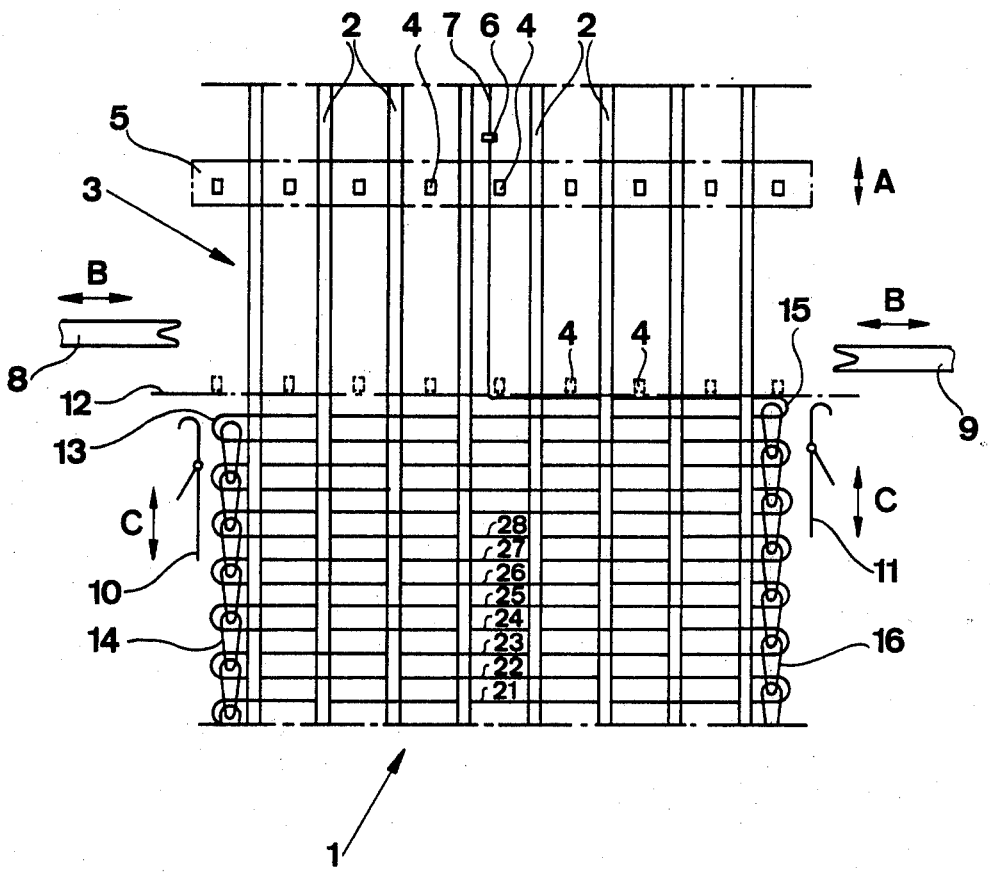
FIG. 1 is a detail top plan view of a loom with the device according to the invention.

In the detail showing of the loom according to FIG. 1, only the parts essential for the understanding of the invention are illustrated purely schematically, all remaining parts being omitted to enhance the illustration of the drawings. A woven fabric 1 in the process of formation displays warp threads 2, which form part of a shed 3 continuing upwardly in the drawing. In the shed 3, the warp threads 2 extend between the webs 4 of a read 5. Arranged behind the read 5 is a thread guide 6, which serves to lead in a weft thread 7 positioned to program. A weft introduction organ in the form of a fork-shaped needle 8 and 9 is present on each side of the shed 3. An edge formation means for the binding-off in the form of a tongue needle 10 and 11 is likewise arranged on each side of the fabric 1.

During the weaving operation, the warp threads 2 raise and lower in known manner and alternately form a shed 3. In the centre of the warp threads 2, the weft thread 7 passes through a tooth gap between two webs 4 of the reed 5 into the working region of the shed 3. As illustrated in FIG. 1, the shed 5 has just executed its beating movement in known manner and completed the weft introduction; in that case, it has moved forwardly in arrow direction A towards the fabric beating edge 12, which is indicated by the webs 4 illustrated in dashed lines whereby the loops 13 and 15 last formed by the weft thread 7 have been anchored in the fabric 1, and has again returned into the setting with the webs 4 illustrated in solid lines.

The control of the fork-shaped needles 8 and 9 in arrow direction B and of the tongue needles 10 and 11 in arrow direction C likewise takes place in known manner. Starting from the setting shown in FIG. 1, the needle 9 now displaces into the shed 3 during the next weft introduction, where it catches the weft thread 7 by the fork in the centre and pushes it out beyond the outermost warp thread 2 while forming a weft thread loop 13. The tongue needle 10 now catches the weft thread loop 13 and binds it off with an auxiliary thread 14 in not illustrated, known manner. While the needle 9 returns without thread into its initial setting, the needle 8 displaces into the shed 3, catches the weft thread 7 by the fork and pushes it out on the other side over the outermost warp thread 2 while forming a weft thread loop 15. There, the weft thread loop 15 is caught by the tongue needle 11 and bound off with an auxiliary thread 16. After the needle 8 has returned into its initial setting, the reed advances and beats both the just formed weft thread loops 13 and 15 against the fabric beating edge 12, whereupon the described process repeats during the next weft introduction and both the next weft thread loops 13 and 15 are formed and brought into the fabric 1.

The use of two auxiliary threads for the formation of the fabric edges is not absolutely necessary, since the weft thread loops can also be bound off with only themselves. Yet, the use of, for example, differently coloured auxiliary threads permits interesting pattern possibilities for the fabric edges. Instead of binding off the weft thread loops, they can also be retained by suitable edge forming means or glued or fixed to the fabric by appropriate means until after the reed beating. Instead of leading the weft thread into the centre of the warp threads, it can also be led in between any two desired warp threads. When the weft thread is led in between any two desired warp threads, for which both the outermost on each side are excluded, then an interesting fabric binding is obtained. As is evident from the course of the weft thread at the places 21 to 28 in FIG. 1, the weft thread in the fabric passes both the warp threads, between which it was led in, in the following manner: crossed—not crossed above—crossed—not crossed below—crossed—not crossed above—crossed—not crossed below—etc.

Figure 2:
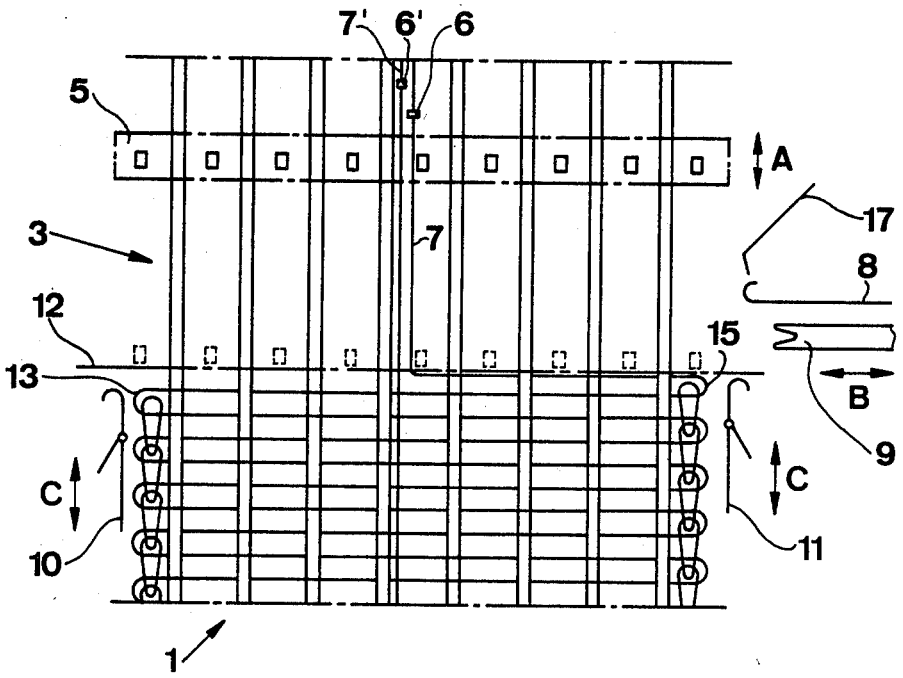
FIGS. 2 and 3 illustrate the same detail as in FIG. 1 with device variants.
Figure 3:
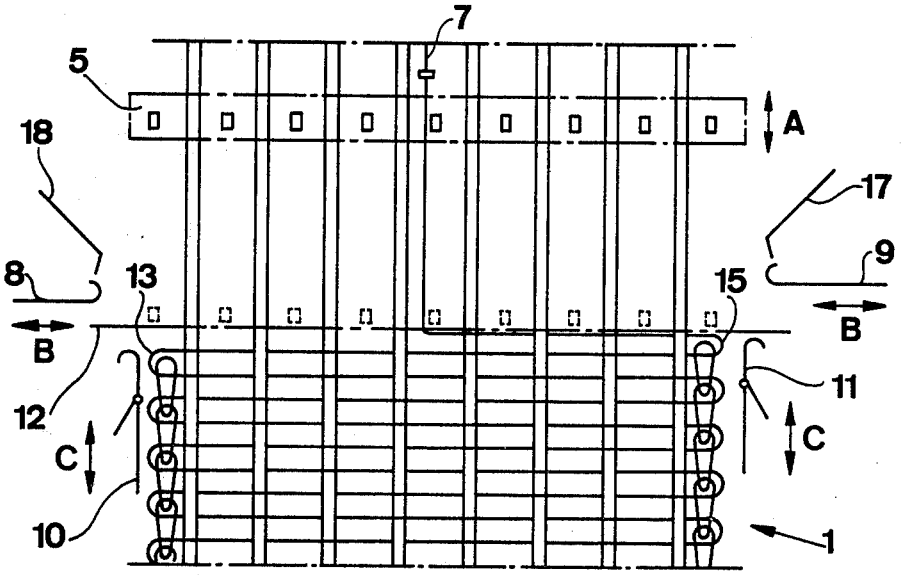

In the variant according to FIG. 2, both weft introduction organs are mounted on the same shed side and they can be constructed as individual organs or as one-piece double organ. During the simultaneous traversing of the shed, the fork-shaped needle 9 again forms the weft thread loop 13, while the weft thread 7 during the return into the initial setting is caught by the needle 8, now constructed in hook shape, and the weft thread loop 15 is formed. After this loop has been taken over by the tongue needle 11 for binding off, a lifting organ 17 belonging to the weft introduction device lifts the weft thread 7 out of the hook of the needle 8 so that both the loops 13 and 15 can be beaten by the reed 5. As is likewise evident from FIG. 2, apart from the thread 7, a still further thread 7' is guided through the same tooth gap of the reed 5. In that case, the thread guides 6 and 6' are apart of an equipment controllable according to pattern so that the weft thread can selectably be chosen alternately from the threads 7 and 7', for example of different colours, while the not selected thread 7' is brought into the fabric as additional warp thread. Both threads can also be led in through other tooth gaps at different places. Also, the weft thread can be selected from more than two threads, which results in a greater multiplicity of patterning, According to FIG. 3, both weft introduction organs are constructed as hook-shaped needles 8 and 9, which reach into the shed 3 simultaneously from each side beyond the centre, seize the weft thread 7 and during their return simultaneously form the weft thread loops 13 and 15. For lifing the thread out of the hooks of the needles 8 and 9 after the loops have been taken over by the tongue needles 10 and 11, a lifting organ 17 and 18 is here arranged on each side.

While there are shown and described present preferred embodiments of the invention, it is to be distinctly understood that the invention is not limited thereto, but may be otherwise variously embodied and practiced within the scope of the following claims. Accordingly,

I claim:

1. In a method of weaving a fabric having two similar edges by means of a loom having a loom reed containing tooth gaps in which at least a weft thread is laid into at least a shed formed of warp threads having a warp direction for the formation of a double-loop extending in zig-zag shape, and in which, to form the edges on both sides of the fabric, alternated left and right looped ends of the double-loops extend beyond the respective outermost warp thread where they are bound with themselves or with an auxiliary thread, glued or fixed together, the improvement comprising the steps of:

feeding, according to program, for each weft thread insertion a weft thread through one of the tooth gaps of the loom reed to introduce, in the warp direction and within the warp width, said weft thread between two warp threads into a shed formed by the warp threads;

forming in the shed said double-loop extending in zig-zag shape from said introduced weft thread by means of two weft thread introduction organs arranged laterally of the shed and spaced in the warp direction, one of said weft thread introduction organs pulling or drawing out the weft thread beyond the outermost warp thread on a side of the shed and the other weft thread introduction organ pulling or drawing out the weft thread beyond the outermost warp thread on the opposite side of the shed; and beating the formed double-loop against a beating edge of the fabric by means of the loom reed.

2. The method according to claim 1, wherein:

pulling or drawing of the weft thread out to the two sides of the shed by means of said weft thread introduction organs is effected successively.

3. The method according to claim 1, wherein:

pulling of the weft thread out to the two sides of the shed by means of said weft thread introduction organs is effected simultaneously.

4. The method according to claim 1, wherein:

the step of feeding comprises feeding through the one tooth gap of the loom reed at least two threads which are selectably used alternately as weft thread or additional warp thread.

5. The method according to claim 1, wherein:

the step of feeding comprises feeding at least two threads each through one respective tooth gap of the loom reed, said threads being selectably used alternately as weft thread or additional warp thread.

6. A shuttleless loom comprising:

a loom reed for beating of the fabric and provided with tooth gaps for guiding the warp threads of a warp having a warp direction;

thread guiding means having at least a thread guide arranged behind the loom reed to fed, according to program, at least a weft thread through one of the reed tooth gaps and to introduce, in the warp direction and within the warp width, said weft thread into a shed formed by the warp threads;

two weft thread introduction organs arranged externally of the shed and movable into the shed;

said weft thread introduction organs being spaced in the warp direction to catch said weft thread introduced into the shed and conduct it in zig-zag manner across the warp by pulling or drawing said weft thread out to each side of the shed and beyond the outermost warp thread respectively; and an edge forming means arranged on the loom at each side of the fabric to catch and hold laterally, the outermost weft thread portions conducted into the shed by said weft thread introduction organs so as to form edges of the fabric.

7. The loom according to claim 6, wherein:

a fork-shaped needle movable over the entire width of the shed is arranged as weft thread introduction organ on each side of the shed.

8. The loom according to claim 6, wherein:

a hook-shaped needle movable over the entire width of the shed is arranged as weft thread introduction organ on each side of the shed.

9. The loom according to claim 6, wherein:

a hook-shaped needle movable beyond the center of the shed is arranged as weft thread introduction organ on each side of the shed.

10. The loom according to claim 6, wherein:

the two weft thread introduction organs are arranged on the same side of the shed, the one being constructed as a fork needle and the other as a hook needle.

11. The loom according to claim 10, wherein:

the fork needle and the hook needle are constructed as one-piece tool.

* * * * *